US008579473B2

(12) United States Patent
Holten et al.

(10) Patent No.: US 8,579,473 B2
(45) Date of Patent: Nov. 12, 2013

(54) LUMINAIRE FOR INDIRECT ILLUMINATION

(75) Inventors: Petrus A. J. Holten, Aalten (NL); Giorgia Tordini, Lyons (FR); Vincent Fabriek, Enschede (NL)

(73) Assignee: Koninklijke Philips N.V., Eindhoven (NL)

( * ) Notice: Subject to any disclaimer, the term of this patent is extended or adjusted under 35 U.S.C. 154(b) by 310 days.

(21) Appl. No.: 13/062,955

(22) PCT Filed: Sep. 4, 2009

(86) PCT No.: PCT/IB2009/053857

§ 371 (c)(1), (2), (4) Date: Mar. 9, 2011

(87) PCT Pub. No.: WO2010/029475

PCT Pub. Date: Mar. 18, 2010

(65) Prior Publication Data

US 2011/0164398 A1 Jul. 7, 2011

(30) Foreign Application Priority Data

Sep. 12, 2008 (EP) ..... 08164194

(51) Int. Cl.
*F21V 7/00* (2006.01)

(52) U.S. Cl.
USPC ..... 362/341; 362/84; 362/297; 362/298; 362/345; 362/351

(58) Field of Classification Search
USPC ..... 362/84, 231, 341, 351, 297, 298, 345
See application file for complete search history.

(56) References Cited

U.S. PATENT DOCUMENTS

| | | | |
|---|---|---|---|
| 6,257,737 | B1 | 7/2001 | Marshall et al. |
| 2003/0095399 | A1 | 5/2003 | Grenda et al. |
| 2007/0263379 | A1 | 11/2007 | Dowling |

FOREIGN PATENT DOCUMENTS

| | | | |
|---|---|---|---|
| DE | 19920404 | A1 | 11/2000 |
| WO | 2008052057 | A2 | 5/2008 |

OTHER PUBLICATIONS

Xi et al, "Quantitative assessment of diffusivity and specularity of surface-textured reflectors for light extraction in light emitting diodes", 2006, pp. 1627-1630, vol. 24, No. 4.

*Primary Examiner* — Stephen F Husar
*Assistant Examiner* — Meghan Dunwiddie
(74) *Attorney, Agent, or Firm* — Mark L. Beloborodov

(57) ABSTRACT

The invention relates to a luminaire (2) and an illumination system (12). The luminaire according to the invention comprises a light exit window (30) for emitting light from the luminaire, and a reflective screen (40) arranged opposite the light exit window. The luminaire further comprises a light source (20) which is arranged for indirect illumination of the light exit window via the reflective screen. The light source is arranged near the light exit window on an imaginary plane P substantially parallel to the light exit window and emits light away from the light exit window. The luminaire further comprises a specularly reflective part (43) as part of the reflective screen, which specularly reflective part is concavely shaped for reflecting at least part of the light emitted by the light source towards a diffusely reflective part (42) of the reflective screen.

The luminaire according to the invention has the effect that use of the specularly reflective part allows an improved controlled reflection of the portion of the light emitted by the light source towards the diffusely reflective part.

14 Claims, 6 Drawing Sheets

LUMINAIRE FOR INDIRECT ILLUMINATION

FIELD OF THE INVENTION

The invention relates to a luminaire for indirect illumination, having a light exit window for emitting light from the luminaire.

The invention also relates to an illumination system comprising the luminaire according to the invention.

BACKGROUND OF THE INVENTION

Traditional luminaires based on fluorescent lamps are more and more replaced by LED-based luminaries. Indeed, LEDs provide great freedom of design and energy advantages. However, by replacing a fluorescent lamp with one or more LEDs, the limited dimensions of this light source offer an extra design challenge because its concentrated brightness must be distributed on a larger surface in order to create an acceptable luminance which is not disturbing to the user.

Luminaires of the type described in the opening paragraph are known per se. They are used, inter alia, as luminaires for general lighting purposes, for example, for office or shop lighting, for example, shop window lighting or lighting of (transparent or semi-transparent) plates of glass or (transparent) synthetic resin on which items, for example, jewelry, are displayed. An alternative application is the use of such illumination systems for illuminating advertising boards, billboards as display devices.

Such a luminaire is described in the non-prepublished patent application PCT/IB2008/052057. This LED luminaire comprises a light exit window, an array of LEDs positioned at the sides of the exit window and a reflective screen opposite the light exit window comprising both a specularly reflective part adjacent the light sources and a diffusely reflective part opposite the light exit window. The LEDs emit lambertian light into the direction of both reflective parts, aiming to transform the LED luminance from a very high and discrete degree to a uniform degree of brightness which is acceptable to the observer. Though said luminaire is an improvement in comparison with the known prior art, the described luminaire still has the drawback that it does not fully comply with the glare restrictions set by the EN12464 norm. Glare results from excessive contrast between bright and dark areas in the field of view. Another drawback is that light is still emitted through the light exit window directly by the specularly reflective part of the reflective screen, i.e. not via its diffusely reflective part, so that light source images still remain visible in the specularly reflective part and increase the risk of glare.

OBJECT AND SUMMARY OF THE INVENTION

It is an object of the invention to provide a luminaire in which at least one of the above-mentioned drawbacks is obviated.

According to a first aspect of the invention, the object is achieved with a luminaire as defined in claim 1. According to a second aspect of the invention, the object is achieved with an illumination system as defined in claim 14. The luminaire according to the invention comprises:

shielding means extending in a plane P and adapted to shield contacting means for holding a light source from being directly viewed by an observer through a light exit window, the shielding means having a first end opposite a second end, the first end bordering a concavely shaped reflective screen and the second end bordering the light exit window, the reflective screen being arranged opposite the light exit window and comprising a specularly reflective part and a diffusely reflective part, a first edge of the diffusely reflective part bordering the light exit window and a second edge bordering a first extremity of the specularly reflective part, a second extremity of the specularly reflective part of the reflective screen bordering the shielding means, said contacting means being positioned between the shielding means and the specularly reflective part of the reflective screen, wherein, viewed in a cross-section perpendicular to plane P and through both the first and the second end of the shielding means, the tangent to the first extremity of the specularly reflective part encloses an angle $\alpha'$ of more than 25° with the plane P.

It is thus realized that the reflective screen is adapted in such a way that light directly impinging from the light source on the specularly reflective part and eventually emitted through the plane P, is emitted through the plane P via subsequent reflection by the specularly reflective part and the diffusely reflective part.

In the non-pre-published patent application, the principal idea is based on a luminaire comprising a specularly reflective part which reflects a major part of the directly impinging light towards the diffusely reflective part. To this end, the specularly reflective part is shaped as a quarter of a circle, viewed in a cross-section. An accurately controlled distribution of part of the light emitted by the light source on the diffusely reflective part of the reflective screen is not yet obtained in said luminaire, as some of the reflected light is not directed towards the diffusely reflective part but to the light exit window or back to the light source instead.

The luminaire according to the invention has the effect that use of the specularly reflective part allows an improved controlled reflection of the portion of the light emitted by the light source towards the diffusely reflective part. The concave shape of the specularly reflective part can be used to control a distribution of the reflected light on at least part of the diffusely reflective part. Typically, a further portion of the light emitted by the light source directly impinges on the diffusely reflective part. The diffusely reflective part subsequently scatters the impinging light towards the light exit window. In the presented optical system, all light reaching the exit window is first reflected by a diffusive surface. This produces a very uniform illumination of the exit window, which is preferred for single-color as well as for color-mixing luminaires and ensures no glare to the observer. Since most light reaches the exit window after maximally two reflections, light will hardly be redirected onto the light source, thus increasing the efficiency of the luminaire. Hence, the optical system maximizes the optical efficiency and additionally minimizes the height of the luminaire.

In the non pre-published patent application, the portion of the specularly reflective part oriented from about 30° to 0° with plane P creates source images which are visible in the exit window. The fact that the light is not directly exposed to the user but first reflected by the mirror does not solve the glare problem, because it is known that a mirror produces an image of the light source that is almost as bright as the source itself, just reduced by the reflection factor, e.g. 0.95 times.

The shape of this specularly reflective part is critical in order to realize the desired effect, and is not simply parabolic. In particular, the first extremity of said specularly reflective part encloses an angle $\alpha'$ of about 30° with plane P. Experiments have proved that a significant part of said images disappear at angles $\alpha'$ of more than 25°. Hence, this is the minimum angle found to counteract visible images of the light source in the light exit window. An upper limit for angle $\alpha'$ is 45°, because the width-to-height ratio becomes unfavorable at larger angles $\alpha'$. The angle $\alpha'$ is preferably at least 28° or somewhat more to about 35°, as at said angle $\alpha'$ of 30° said visible images are just no longer visible in the light exit window, thus counteracting glare for observers, because all light is redirected to the diffusely reflective part.

In the non pre-published patent application, particularly the shape (viewed in a cross-section) of the initial portion of the specularly reflective part, i.e. the portion that borders the shielding means, poses a high risk of back radiation on the light source, for example, on the Light Emitting Diodes (further referred to as LEDs) and on the Printed Circuit Board (further referred to as PCB) on which said LEDs are mounted. Moreover, when two facing luminaires are used, it may cause light to cross over within the luminaire from the side where the flux is generated to the other side and may be redirected to the area where the PCBs and LEDs are positioned and where the light is absorbed. The specularly reflective part according to the invention has a critical shape in order to realize the desired effect, and is not simply parabolic. To this end, an embodiment of the luminaire according to the invention is characterized in that, viewed in a cross-section perpendicular to plane P and through both the first and the second end of the shielding means, the tangent to the second extremity of the specularly reflective part encloses an angle $\alpha$ of more than 90° with the plane P, preferably more than 115°. It is achieved by said shape that energy losses are further reduced in that both cross-over and redirection of light towards the light source are counteracted and that this light is distributed on the diffusely reflective part instead.

The luminance distribution at the light exit window of the luminaire according to the invention is determined by a combination of the specularly reflective part and the diffusely reflective part and is influenced by the concave shape of the specularly reflective part. When, for example, a specific shape of the specularly reflective part is chosen, a substantially uniform luminance distribution may be obtained at the light exit window of the luminaire, which may be further improved by adaptation of the shape of the diffusely reflective part. To this end, another embodiment of the luminaire according to the invention is characterized in that, viewed in a cross-section perpendicular to plane P and through both the first and the second end of the shielding means, tangents to portions of the specularly reflective part being positioned closer to plane P than the light source enclose an angle $\alpha$ of more than 90° with the plane P, said angle $\alpha$ continuously decreasing from the second extremity to the first extremity of the specularly reflective part.

The uniformity of the light output through the light exit window can be further influenced via control of the beam characteristics of the light source. This may be effected via control of the direction and/or the intensities of the light beam. It has appeared from experiments that favorable results are obtained with an embodiment of the luminaire according to the invention, which is characterized in that the light generated upon operation of the light source is treated differently for a first and a second fraction of light, the first fraction impinging directly on the diffusely reflective part having a light intensity distribution which is typical of a lambertian light source, i.e. in accordance with $I(\gamma)=I(0)\cos(\gamma)$, wherein $\gamma$ is the angle at which a light ray is emitted with respect to plane P and ranges from about 0° to about 60° for the first fraction, the second fraction, for which $\gamma$ ranges between about 60° and about 180°, impinging directly on the specularly reflective part, which second fraction is redirected to the diffusely reflective part and concentrated by the specularly reflective part to angles $\gamma$ ranging between about 5° and about 35°. Due to the concentration of the second fraction of light emitted at angles $\gamma$ from 60° to 180° to angles $\gamma$ from 5° to 35°, i.e. concentrated from a range of about 120° to a range of about 30°, the intensity of said second fraction becomes higher than the intensity of the first fraction of light covering only a range of about 60°. Alternatively or additionally to further improving the uniformity of the light output, the range of angles for the first and the second fraction of light may be varied so as to vary the intensity ratio of the first and the second fraction of light. The first fraction and the second fraction preferably have an intensity ratio in the range from 1:10 to 1:3.

In another embodiment, the luminaire according to the invention is characterized in that the diffusely reflective part comprises a first, a second and a third portion, the second portion being positioned between the first portion and the third portion and being tangentially connected to the first and the third portion, the first portion being concavely curved and comprising the second edge of the diffusely reflective part which is tangential to the first extremity of the specularly reflective part. Such a luminaire is favorably combined with a combination of a light source and a specularly reflective part, which jointly generate said first and second fraction of light. The first fraction of light has relatively low intensities but is rather close to the first portion. This first portion therefore needs to be oriented substantially parallel to the propagation of rays of the first fraction of light in order to decrease the flux density on this first portion. By controlling the orientation of the first portion, its illumination has about the same magnitude as the second and the third portion which are illuminated by the second fraction.

Said second fraction of light has progressively increasing intensities from approx. $\gamma=35°$ to $\gamma=15°$, in order to illuminate the second portion sufficiently. The third portion is the most distant from the origin of the second fraction of light and therefore requires the highest intensities for sufficient illumination. For this reason, the second fraction of light progressively increases in intensity from approx. $\gamma=15°$ to approx. $\gamma=5°$, which corresponds to the end of the third portion. Furthermore, in view of the large distance between the light source and the third portion, the orientation of the second portion needs to be about perpendicular to the propagation of rays of the second fraction of light in order to maximize the flux density and achieve a sufficient illumination.

When the two fractions of light are combined for a uniform illumination of the diffusely reflective part, the orientation of the first portion is found to be substantially parallel to the direct propagation of light, while the orientation of the third portion is more transverse to it. This determines a typical geometry of the diffusely reflective part of the reflective screen and provides a uniform illumination of the diffusely reflective part and hence a uniform light output of the luminaire via the light exit window. A good uniformity is particularly obtained with a luminaire which is characterized in that, viewed in a cross-section perpendicular to plane P and through both the first and the second end of the shielding means, the second portion has a straight shape. The portions which are tangential counteract discontinuities in observed light intensities between the various portions, thus improving the uniformity of the light output through the light exit window.

In one embodiment, the luminaire has a height in the range of 1/5 to 1/20 of a width of the luminaire, wherein said height is measured along a perpendicular to the plane P and said width is measured parallel to plane P. When the luminaire has a width of more than twenty times the height of the luminaire, the luminance distribution at the light exit window is difficult to control. A relatively small variation of the shape of the specularly reflective mirror or of the position of the light source with respect to the specularly reflective mirror may already have a significant impact on the luminance distribution at the light exit window. When the luminaire has a width of less than four times its height, the luminaire becomes relatively bulky and less suited to be built into false ceilings.

In a further embodiment, the luminaire is characterized in that the shielding part has a reflective surface facing the specularly reflective part. The efficiency of the luminaire is thus further improved.

In another embodiment of the luminaire, the diffusely reflective part has a structured reflective surface. This embodiment has the advantage that the structured reflective surface counteracts specular reflections which may occur when light impinges on a diffusely reflective surface at grazing angles. The structured reflective surface may be obtained, for example, by roughening the reflective surface using, for example, a spray-coated reflector or lamellae, by forming an undulated surface, or by using a substantially transparent prismatic sheet. Such a transparent prismatic sheet is, for example, commercially known as Transmissive Right Angle Film (also known as TRAF), or Brightness Enhancement Film (also known as BEF) or Optical Lighting Foil (also known as OLF). These substantially transparent prismatic sheets redirect the light impinging at grazing angles, so that it impinges on the diffusely reflective part at an angle closer to a normal of the diffusely reflective part.

In an embodiment of the luminaire, the structured reflective surface comprises a plurality of elongated prismatic structures, or a plurality of pyramidal structures, or a plurality of conical structures. As indicated hereinbefore, these structures prevent the light reflected by the specularly reflective mirror from impinging on the diffusely reflective part at grazing angles.

In another embodiment of the luminaire, the diffusely reflective part comprises a collimating plate, or a redirecting foil, or a plurality of lamellae arranged substantially perpendicularly to the diffusely reflective part. Again, the use of a collimating plate, redirecting foil or lamellae prevents the light reflected by the specularly reflective mirror from impinging on the diffusely reflective part at grazing angles. The collimating plate and the redirecting foil are typically constituted by translucent material which is arranged to redirect a grazing light beam, for example, from the specularly reflective part, so that it impinges on the diffusely reflective part at an angle near a normal axis to the diffusely reflective part.

In yet another embodiment, the luminaire comprises a remote phosphor layer arranged on the diffusely reflective part and/or on the light exit window, the remote phosphor layer comprising a luminescent material for converting at least part of the light emitted by the light source to light having a different color. A remote phosphor allows optimization of the color rendering index (further also referred to as CRI) of the luminaire, which is particularly advantageous when the luminaire is used in a general lighting application. Furthermore, the use of the remote phosphor for determining a color of the light emitted by the luminaire typically results in an improved efficiency and a wider choice of luminescent materials as compared to a luminaire in which the luminescent material is directly applied to the light source, for example, on a low-pressure discharge lamp or on a phosphor-converted light-emitting diode.

In a further embodiment, the luminaire comprises an array of further light sources arranged on the diffusely reflective part for direct illumination of the light exit window, a color of the light emitted by the light source being different from a color of the light emitted by the array of further light sources. This embodiment has the advantage that a color of the light emitted by the luminaire can be tuned, for example, by tuning a quantity of light emitted by the light source. The light emitted by the light source is distributed, partially via the specularly reflective part, on the diffusely reflective part, which results in, for example, a substantially uniform distribution of the light emitted by the light source at the light exit window. The light from the light source mixes with the light emitted by the array of further light sources and determines a color of the light emitted by the luminaire according to the invention. Tuning the quantity of light emitted by the light source determines a change of the color of the overall light emitted by the luminaire. In this way, only a few light sources, for example, arranged at the edge of the light exit window, are required to obtain a color-tunable luminaire.

In an embodiment of the luminaire, the light exit window comprises a diffuser, or a Brightness Enhancement Film, or Micro Lighting Optics, or a prismatic sheet, or a plurality of lamellae arranged substantially perpendicularly to the light exit window. The Brightness Enhancement Film, or Micro Lighting Optics are commercially available products for redirecting light emitted from a luminaire, for example, when the luminaire is used in a backlighting system. Furthermore, when these sheets or films are used on the light exit window of the luminaire, the uniformity of the light emitted by the luminaire is further improved. Considering that the luminance transformation is realized by the other components of the optical system, the exit window may be open, without any hindrance to the observer.

The exit window may also be closed by a transparent cover. In both cases, the light beam generated by the luminaire will be lambertian. The exit windows may also be closed by a translucent panel having an optical structure (e.g. structures with conical lenses or pyramidal prisms) or by a louver, in order to transform the lambertian light distribution into a more collimated light beam.

The invention also relates to an illumination system comprising at least one luminaire according to the invention. The illumination system is understood to be combinations of at least two luminaires for general lighting purposes, for example, office lighting or, alternatively, backlighting systems, for example, TV sets and monitors, displays, for example, liquid crystal displays used in portable computers and/or (portable) telephones. The illumination system preferably comprises two luminaires with coinciding planes P, said two luminaires facing each other and bordering each other with the first end of their diffusely reflective part. Such a configuration has the advantage that it can be treated as a single luminaire.

The invention allows realization of low-height, high-comfort luminaires with great freedom of form. The invention may relate to a single luminaire. Alternatively, the invention may relate to the base component for realization of a variety of indoor and outdoor illumination systems, which can be achieved by including extra beaming optics, such as louvers or collimating panels, at the light exit window of the optical system. The invention is suitable for realization of high-quality displays or for backlighting imaging and non-imaging devices.

BRIEF DESCRIPTION OF THE DRAWINGS

These and other aspects of the invention are apparent from and will be elucidated with reference to the embodiments described hereinafter.

In the drawings.

The Figures are purely diagrammatic and not drawn to scale. Particularly for clarity, some dimensions are strongly exaggerated. Similar components in the Figures are denoted by the same reference numerals as much as possible.

DESCRIPTION OF EMBODIMENTS

Figure 1A:
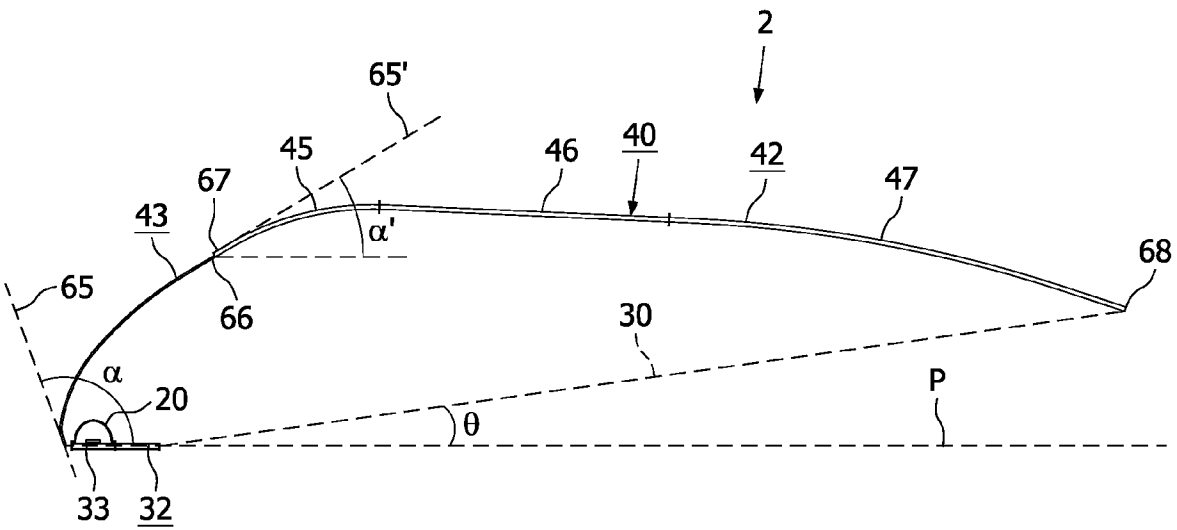
FIGS. 1A, 1B and 1C are respective cross-sectional views of various embodiments of luminaires according to the invention.
Figure 1B:
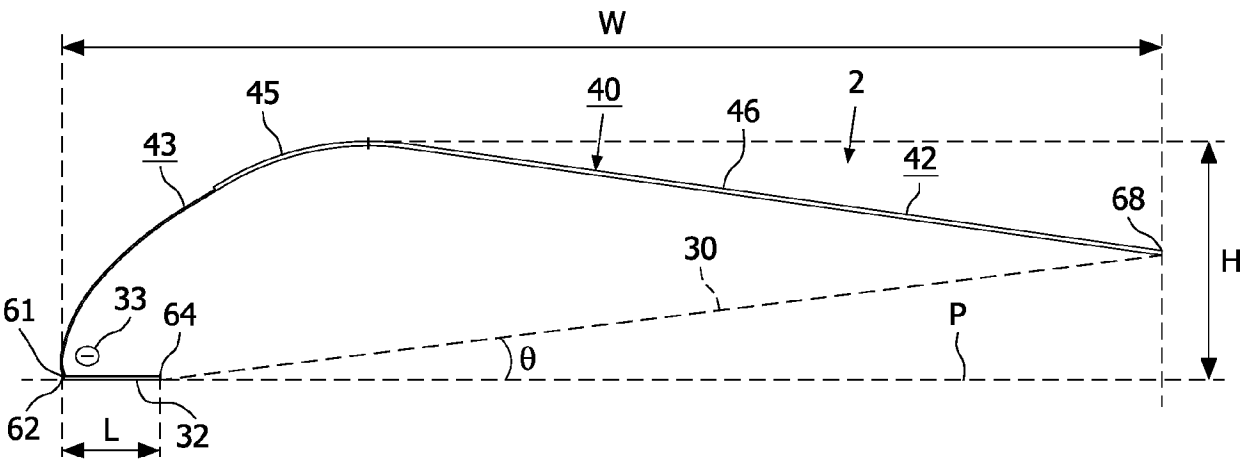
Figure 1C:
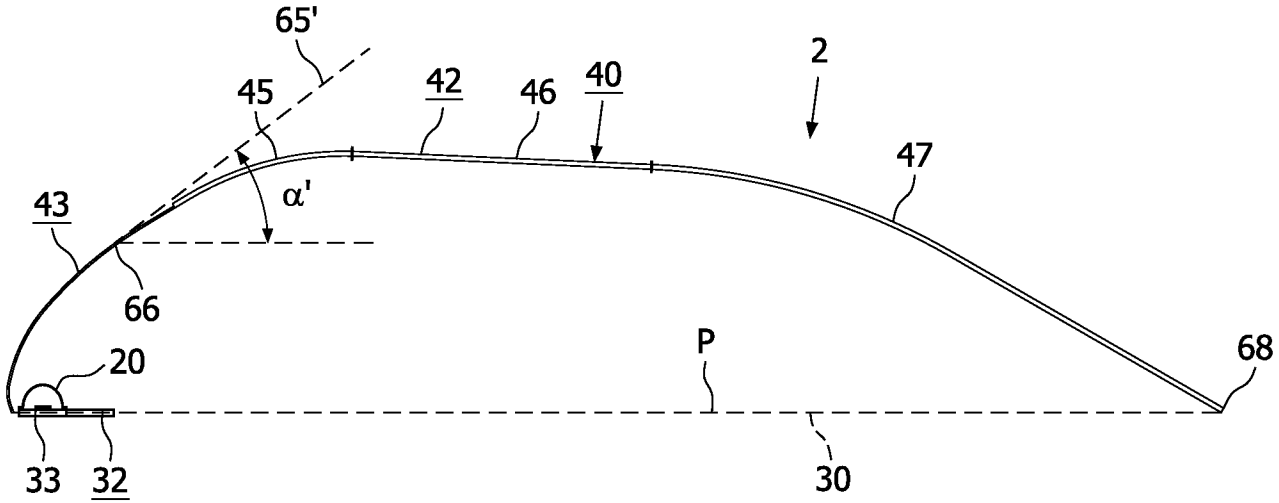

FIGS. 1A, 1B and 1C are cross-sectional views of a luminaire 2 according to the invention. The luminaire 2 comprises a light exit window 30 for emitting light from the luminaire 2 and a reflective screen 40 arranged opposite the light exit window 30. The luminaire 2 further comprises a light source 20 which is arranged for indirect illumination of the light exit window 30 via a diffusely reflective part 42 of the reflective screen 40 which further comprises a specularly reflective part 43. The light source 20 is held in electric contacting means 33 and arranged near the light exit window 30. Shielding means 32 define an imaginary plane P substantially parallel to the light exit window 30 and shield the contacting means 33 from being directly viewed by an observer through the light exit window 30. The specularly reflective part 43 is concavely shaped towards the light exit window 30 for reflecting at least part of the light emitted by the light source 20 towards the diffusely reflective part 42.

Figure 2:
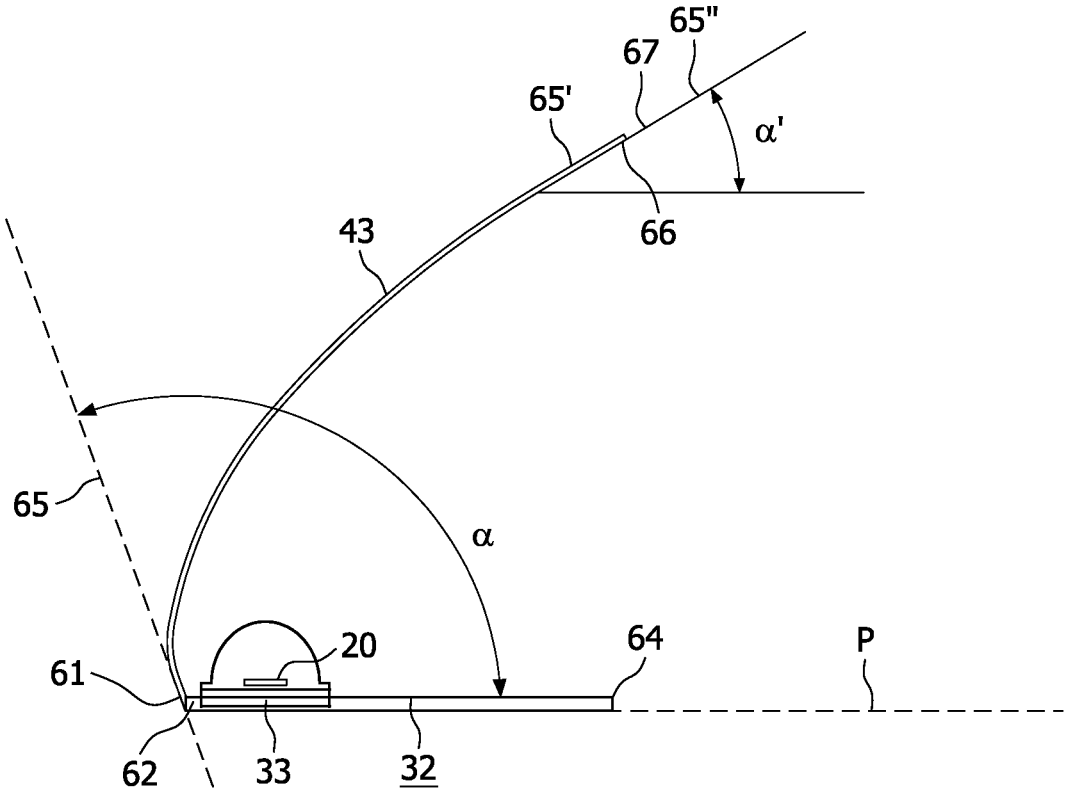
FIG. 2 is a detailed view of the luminaire of FIG. 1A of the specularly reflective part and shielding means of the luminaire according to the invention.

In a preferred embodiment of the luminaire 2 according to the invention, the light source 20 is at least one LED 20 held in electric contacting means 33, a PCB in the case of LEDs, as shown in FIGS. 1A, 1C and 2. However, the light source 20 may be any suitable light source, such as a low-pressure mercury gas discharge lamp, for which electric contacting means 33 are shown in FIG. 1B, or a high-pressure mercury gas discharge lamp, a halogen incandescent lamp or a laser light source.

In the embodiment of the luminaire 2 as shown in FIGS. 1A and 1C, the light source 20 is arranged between the specularly reflective part 43 and the shielding means 32 on the shielding means 32. In the embodiment shown in FIG. 1B, the light source 20 is to be positioned between the specularly reflective part 43 and the shielding means 32 and to be accommodated in the electric contacting means 33. The shielding means 32 has a width L and, in the embodiments shown in FIGS. 1A-C, is arranged adjacent to the light exit window 30. A first end 62 of the shielding means 32 is connected to a second extremity 61 of the specularly reflective part 43 and a second end 64 of the shielding means 32 borders the light exit window 30.

The luminaire 2 according to the invention has a height H which is a dimension of the luminaire 2 in a direction substantially perpendicular to the plane P. The light exit window 30 of the luminaire 2 has a width W which is a minimum dimension of the luminaire 2 substantially parallel to the plane P. In an embodiment of the luminaire 2, in which the luminaire 2 is rectangular, the light exit window 30 also has a length (not indicated, but indicatively shown in FIG. 7) which is a maximum dimension of the light exit window 30 substantially parallel to the plane P (and typically perpendicular to the width W). The luminaire 2 according to the invention preferably has such a height H and width W that:

height/width≥1/20, said ratio is 1/6 in FIGS. 1A-C.

Within this range, the luminance distribution at the light exit window 30 can still be relatively well controlled.

FIG. 1A shows a preferred embodiment of the luminaire 2 according to the invention. The reflective screen 40 comprises the specularly reflective part 43 and the diffusely reflective part 42. FIG. 2 is a detailed view of the specularly reflective part 43. The second extremity 61 of the specularly reflective part 43 is connected to the first end 62 of the shielding means 32, while a tangent 65 to said second extremity 61 encloses an angle $\alpha$ of about 110° with plane P. The angle $\alpha$ of said tangent 65 with respect to the specularly reflective part 43 continuously decreases from the second extremity 61 to a first extremity 66 of the specularly reflective part 43. Said first extremity 66 is connected to a second edge 67 of the diffusely reflective part 42. The first extremity 66 and the second edge 67 are tangential, i.e. the tangent 65' to said first extremity 66 and the tangent 65" to said second edge 67 are the same and measure an angle $\alpha'$ of about 30° with respect to plane P.

In FIG. 1A, the diffusely reflective part 42 comprises a first, a second and a third portion 45, 46, 47, respectively. The second portion 46 has a straight shape and is positioned between the first portion 45 and the third portion 47 and is tangentially connected to both portions. The first portion 45 is concavely curved towards the light exit window 30 and comprises the second edge 67 of the diffusely reflective part 42. The third portion 47 is concavely shaped towards the plane P and comprises a first edge 68 of the diffusely reflective part 42 by which it borders the light exit window 30. Said first edge 68 does not lie in plane P and, as a result, the light exit window 30 encloses a relatively small angle $\Theta$ of less than 10° with plane P, see in particular FIG. 1B. This embodiment has the advantage that a relatively excellent uniform light output via the light exit window 30 of the luminaire 2 is obtained as a result of the shape of the specularly reflective part 43 and the shape of the first, second, and third portion 45, 46, 47 of the diffusely reflective part 42. The specific shape of the reflective screen enables it to be easily connected to a second luminaire 2 oriented in a mirrored position (see FIG. 4).

FIG. 1B shows a relatively simple embodiment of the luminaire 2 according to the invention, in which the second and the third portion 46, 47 of the diffusely reflective part 42 are integral and extend straight in the same direction. It is suitable for accommodating a fluorescent tube, to be held in the contacting means 33, and is cheap and easy to manufacture. A satisfactorily uniform light output is obtained with this embodiment.

FIG. 1C shows an embodiment of the luminaire 2 according to the invention, in which the diffusely reflective part 42 extends into plane P. The plane P in this luminaire 2 coincides with the light exit window 30. The tangent 65' to the first extremity 66 of the specularly reflective part 43 encloses an angle $\alpha$ of 40° with plane P. This embodiment of the luminaire 2 according to the invention is particularly suitable for use as a single or stand-alone luminaire.

Figure 3A:
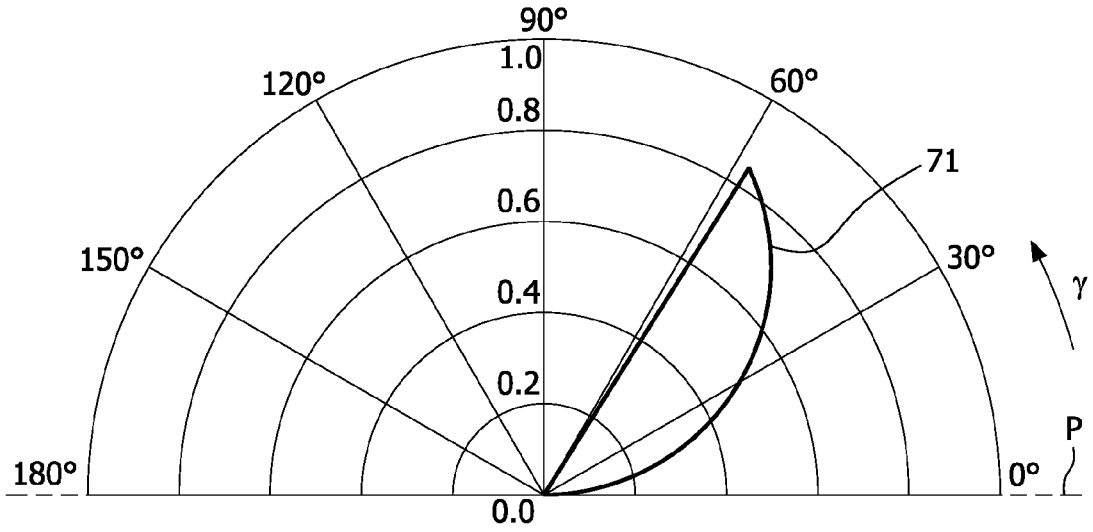
FIGS. 3A and 3B show the light beam characteristics of a LED light source of a luminaire according to the invention.
Figure 3B:
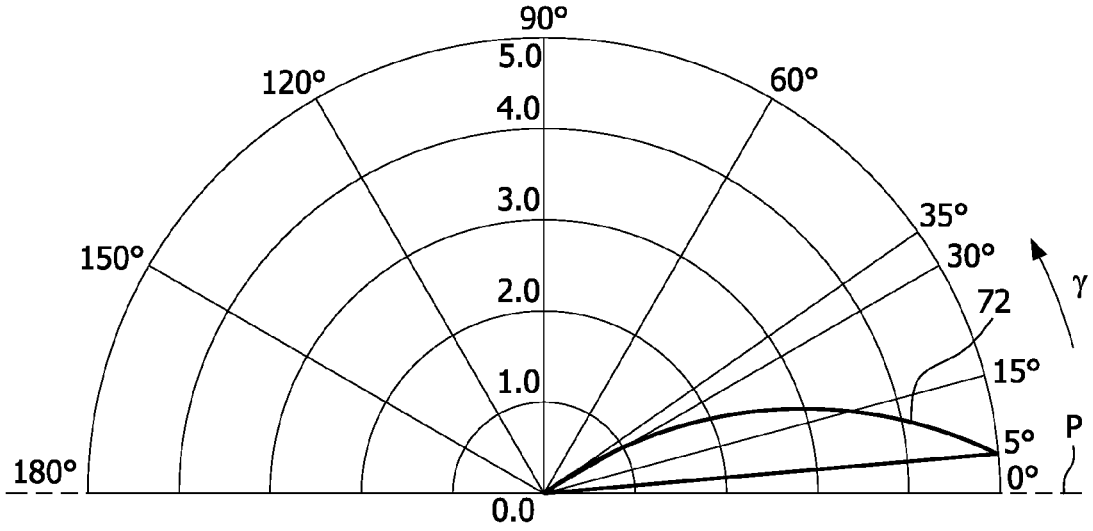

FIGS. 3A and 3B show a specific, favorable light distribution comprising a first and a second fraction 71, 72, respectively, of light of different light intensities directed towards the diffusely reflective part 42, see also FIG. 1A. The first fraction 71 impinges directly on the diffusely reflective part 42 having a light intensity distribution in accordance with $l(\gamma)=l(0)\cos(\gamma)$, wherein $\gamma$ is the angle at which a light ray is emitted with respect to plane P. For the first fraction 71, $\gamma$ ranges from 0° to 60°. The second fraction 72, for which $\gamma$ ranges between 60° and 180°, impinges directly on the specularly reflective part 43. This second fraction 72 is redirected to the diffusely reflective part 42 and concentrated by the specularly reflective part 43 to angles $\gamma$ ranging between 5° and 35°.

The luminaire 2 shown in FIG. 1A is preferably combined with a light source and the specularly reflective part generating said first and second fraction 71,72 of light. The first fraction 71 of light has relatively low intensities but is rather close to the first portion 45 of the diffusely reflective part 42 (see FIG. 1A). This first portion 45 is therefore oriented substantially parallel to the propagation of rays of the first fraction 71 of light in order to decrease the flux density on this first portion. By controlling the orientation of the first portion 45, its illumination has substantially the same magnitude as the second and third portion 46, 47 (see FIG. 1A) illuminated by the second fraction 72.

The second fraction 72 of light has progressively increasing intensities from approx. $\gamma=35°$ to $\gamma=15°$, in order to illuminate the second portion 46 sufficiently. The third portion 47 is most distant from the origin of the second fraction 72 of light and therefore requires the highest intensities for sufficient illumination. For this reason, the second fraction 72 of light progressively increases in intensity from approx. $\gamma=15°$ to approx. $\gamma=5°$, which corresponds to the end 68 on the third portion 47. Furthermore, in view of the large distance between the light source 20 and the third portion 47, the orientation of the second portion 46 needs to be substantially perpendicular to the propagation of rays of the second fraction 72 of light in order to maximize the flux density and achieve sufficient illumination. It is for the above-mentioned reasons that the intensity ratio of the first fraction 71 and the second fraction 72 of light is in the range of 1/10 to 1/3. In FIGS. 3A and 3B, the first fraction 71 of light has an intensity which is about 1/6 of the intensity of the second fraction 72 of light.

Figure 4:
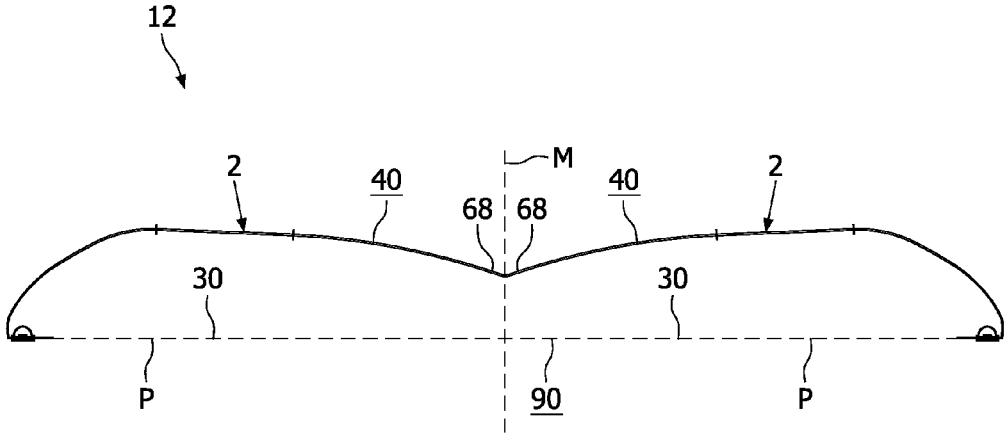
FIG. 4 is a cross-sectional view of an embodiment of an illumination system according to the invention.

FIG. 4 shows an illumination system 12 according to the invention. This illumination system 12 comprises two luminaires 2 as shown in FIG. 1C. The two luminaires 2 are arranged in a mirror configuration on either side of a mirror plane M which extends through the respective ends 68 of the reflective screen 40 of each luminaire 2 and perpendicularly to the respective plane P of each luminaire 2. The respective planes P of the respective luminaires 2 coincide with each other. The respective light exit windows 30 form an integral light exit window 90.

Figure 5:
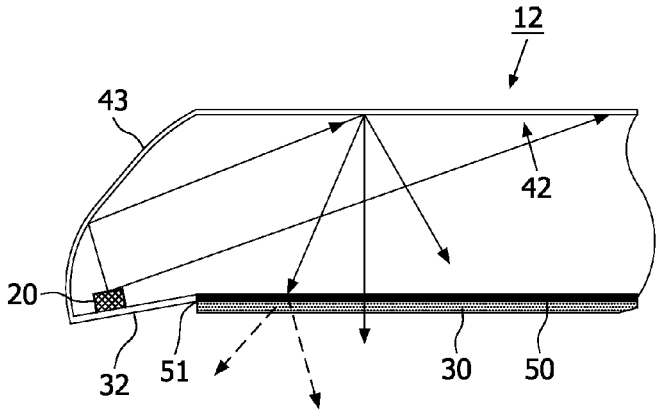
FIG. 5 is a partial cross-sectional view of an illumination system according to the invention, comprising a remote phosphor.

FIG. 5 is a partial cross-sectional view of an embodiment of an illumination system 12 according to the invention, comprising a remote phosphor layer 50. In the embodiment shown in FIG. 5, the remote phosphor layer 50 is applied on a transparent panel 51 which is provided in the light exit window 30. This embodiment has the advantage that the panel 51 with the remote phosphor layer 50 can be applied relatively easily to the illumination system 12. Alternatively, the luminescent material is applied in a diffusely reflecting layer of the diffusely reflective part 42 such that the diffusely reflecting layer acts as the remote phosphor layer (not shown). This embodiment has the advantage that the uniformity of the applied remote phosphor layer 50 is less critical with respect to the luminance uniformity at the light exit window 30 because of the distance between the remote phosphor layer 50 and the light exit window 30. Due to this additional distance between the remote phosphor layer 50 and the light exit window 30, the light generated by the remote phosphor layer 50 is mixed before it is emitted by the illumination system 12 according to the invention. The remote phosphor layer 50 may comprise a single luminescent material or a mixture of a plurality of different luminescent materials. Alternatively, the illumination system according to the invention comprises a remote phosphor layer 50 at both the light exit window 30 and on the diffusely reflective part 42 (not shown). In such an embodiment, the remote phosphor layer 50 applied to the diffusely reflective part 42 may be different, for example, it may comprise a different luminescent material or a different mixture of luminescent materials as compared to the remote phosphor layer 50 applied to the light exit window 30.

In a preferred embodiment, the light source is a LED 20 which emits substantially blue light. Part of the blue light will be converted, using, for example, $Y_3Al_5O_{12}:Ce^{3+}$ (further also referred to as YAG:Ce) which converts part of the blue impinging light to yellow light. The color of the light emitted by the illumination system 12 according to the invention may be cool white by choosing a right conversion of the blue light to yellow. The ratio of blue light which is converted by the remote phosphor layer 50 may be determined, for example, by a layer thickness of the remote phosphor layer 50, or, for example, by a concentration of the YAG:Ce particles distributed in the remote phosphor layer 50. Alternatively, for example, $CaS:Eu^{2+}$ (further also referred to as CaS:Eu) may be used, which converts part of the blue impinging light to red light. Adding some CaS:Eu to the YAG:Ce may result in white light having an increased color temperature. Alternatively, the LED 20 emits ultraviolet light which is converted to substantially white light by the remote phosphor layer 50. For example, a mixture of $BaMgAl_{10}O_{17}:Eu^{2+}$ (converting ultraviolet light to blue light), $Ca_8Mg(SiO_4)_4Cl_2:Eu^{2+},Mn^{2+}$ (converting ultraviolet light to green light), and $Y_2O_3:Eu^{3+},Bi^{3+}$ (converting ultraviolet light to red light) with different phosphor ratios may be used to choose a color of the light emitted from the illumination system 12 in a range from relatively cold white to warm white, for example, between 6500K and 2700K. Other suitable phosphors may be used to obtain a required color of the light emitted by the illumination system 12.

FIG. 5 further shows that the shielding means 32 are inclined inwardly towards the specularly reflective part 43 with respect to the light exit window 30. This configuration relatively easily shields the contacting means and hence the light source 20 from being viewed directly through the light exit window 30.

Figure 6:
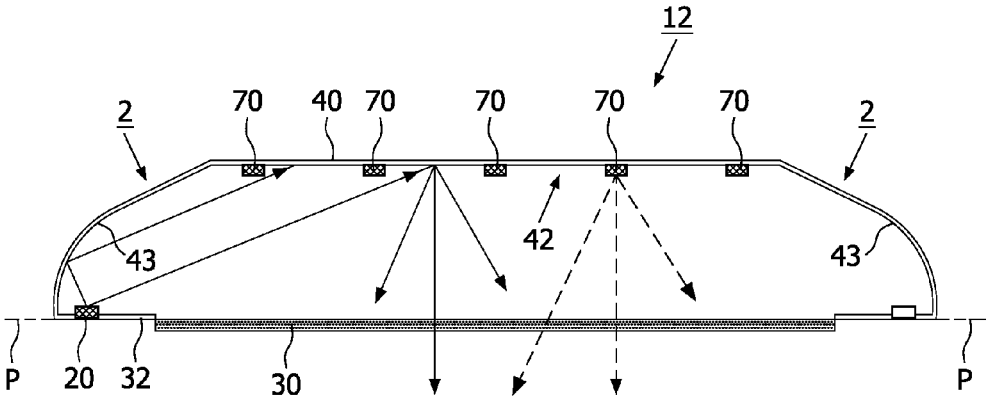
FIG. 6 is a cross-sectional view of an illumination system according to the invention, in which, in addition to the light source, the luminaire further comprises an array of further light sources arranged at the diffusely reflective screen, FIGS. 7A and B are perspective views of embodiments of an illumination system and of a luminaire according to the invention.

FIG. 6 is a cross-sectional view of an illumination system 12 according to the invention, in which the illumination system 12 comprises two luminaires 2 arranged in a mutually opposite configuration, with their planes P coinciding. In addition to the light source 20, the illumination system 12 further comprises an array of further light sources 70 arranged at the diffusely reflective part 42 of the reflective screen 40. A color of the light emitted by each further light source 70 in the array of further light sources 70 is different from the color of the light emitted by the light source 20. The illumination system 12 as shown in FIG. 6 may comprise, for example, a color-tunable illumination system 12 in which the array of further light sources 70 determines a basic color of the light emitted by the illumination system 12 which may be tuned by adding light from the light source 20. The added light from the light source 20 is distributed substantially homogeneously on the light exit window 30, using the specularly reflective part 43 which reflects at least part of the light emitted by the light source 20 across the diffusely reflective part 42. For example, when the array of further light sources 70 emits substantially white light, the addition of red light, for example, emitted by the light source 20 reduces a color temperature of the white light of the array of further light sources 70. Alternatively, the color temperature of the white light increases when blue light, which is emitted, for example, by the light source 20 is added to the substantially white light emitted by the array of further light sources 70. In an embodiment of the illumination system 12 according to the invention, the light source 20 is constituted by an array of light sources 20 arranged on, for example, the shielding means 32, which array comprises both blue light-emitting LEDs and red light-emitting LEDs. This arrangement of LEDs 20 allows the color temperature of the light emitted by the illumination system 12 to be both increased and decreased, depending on which color from the array of light sources 20 is added to the light emitted by the array of further light sources 70. Consequently, the tunability of the illumination system 12 according to the invention is increased.

Figure 7A:
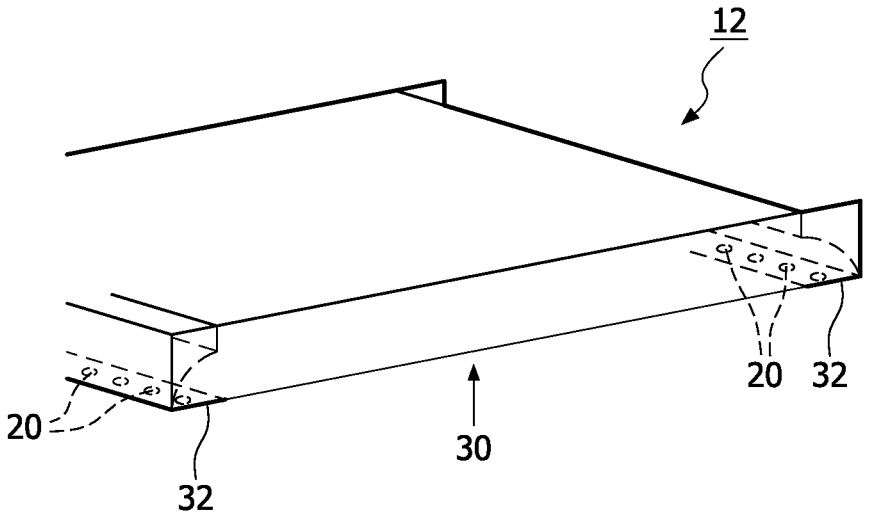
Figure 7B:
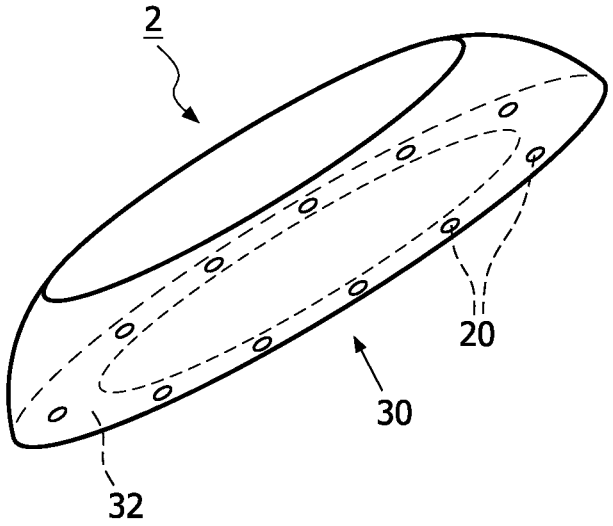

FIGS. 7A and 7B are partially transparent three-dimensional views of the luminaire 2 and the illumination system 12 according to the invention. FIG. 7A shows the illumination system 2 according to the invention with a substantially rectangular light exit window 30. The embodiment shown in FIG. 7A comprises shielding means 32 arranged on opposite sides of the light exit window 30 extending along the length of the light exit window 30. Each shielding means 32 is embodied as a ridge and comprises a plurality of LEDs 20 as light sources 20. FIG. 7B shows the luminaire 2 according to the invention with an ellipsoidal light exit window 30, for example, a circular light exit window 30. The shielding means is an annular ridge 32 which comprises the plurality of LEDs 20 as light sources 20 and is arranged around the light exit window 30.

It should be noted that the above-mentioned embodiments illustrate rather than limit the invention, and that those skilled in the art will be able to design many alternative embodiments without departing from the scope of the appended claims. For example, the shielding means may be inclined with respect to plane P, or, for example, the luminaire may further comprise a plurality of lamellae extending substantially perpendicularly from the diffusely reflective part towards the light exit window. The surface of the lamellae also diffusely reflects impinging light. Use of the plurality of lamellae substantially prevents light reflected from the specularly reflective part from impinging on the diffusely reflective part at large grazing angles. Instead, light approaching the diffusely reflective part at relatively large grazing angles impinges on the diffusely reflecting lamellae and is substantially diffusely reflected by said lamellae. When light impinges on the diffusely reflective part at grazing angles, a part of the light may not be diffusely reflected but may be substantially specularly reflected. If the light distribution on the diffusely reflective part is substantially uniform, the luminance distribution at the light exit window may not be uniform due to the partial specular reflection of the light impinging on the diffusely reflective part at grazing angles. Hence, the reflection characteristic of the diffusely reflective part more closely resembles a substantially Lambertian diffuser. Alternatively, the diffusely reflective part of the illumination system has a structured surface, for example, an elongated prismatic structure, or, for example, a cross-sectional view of a plurality of pyramidal structures, or a cross-sectional view of a plurality of conical structures. The effect of this structured surface is to prevent light from impinging on the diffusely reflective part at grazing angles, which, as indicated hereinbefore, has the result that a reflection characteristic of the diffusely reflective part more closely resembles a Lambertian diffuser.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A luminaire for indirect illumination, the luminaire comprising:

shielding means extending in a plane P and adapted to shield contacting means for holding a light source from being directly viewed by an observer through a light exit window, the shielding means having a first end opposite a second end, the first end bordering a concavely shaped reflective screen and the second end bordering the light exit window, the reflective screen being arranged opposite the light exit window and comprising a specularly reflective part and a diffusely reflective part, a first edge of the diffusely reflective part bordering the light exit window and a second edge bordering a first extremity of the specularly reflective part, a second extremity of the specularly reflective part of the reflective screen bordering the shielding means, said contact means being positioned between the shielding means and the specularly reflective part of the reflective screen, wherein, viewed in a cross-section perpendicular to plane P and through both the first and the second end of the shielding means, the tangent to the first extremity of the specularly reflective part encloses an angle $\alpha'$ of more than 25° with the plane P, wherein the shielding part has a reflective surface facing the specularly reflective part.

2. A luminaire as claimed in claim 1, wherein the angle $\alpha'$ is in the range of 28° to 35°.

3. A luminaire as claimed in claim 1, wherein, viewed in a cross-section perpendicular to plane P and through both the first and the second end of the shielding means, the tangent to the second extremity of the specularly reflective part encloses an angle $\alpha$ of more than 90° with the plane P.

4. A luminaire as claimed in claim 3, wherein, viewed in a cross-section perpendicular to plane P and through both the first and the second end of the shielding means, tangents to portions of the specularly reflective part positioned closer to plane P than the light source enclose an angle $\alpha$ of more than 90° with the plane P, said angle $\alpha$ progressively decreasing from the second extremity to the first extremity of the specularly reflective part.

5. A luminaire as claimed in claim 1, wherein the light generated upon operation of the light source is treated differently for a first and a second fraction of light, the first fraction impinging directly on the diffusely reflective part having a light intensity distribution in accordance with $I(\gamma)=I(0)\cos(\gamma)$, wherein $\gamma$ is the angle at which a light ray is emitted with respect to plane P and ranges from 0° to 60° for the first fraction, the second fraction, for which $\gamma$ ranges between 60° and 180°, impinging directly on the specularly reflective part, which second fraction is redirected to the diffusely reflective part and concentrated by the specularly reflective part to angles γ ranging between 5° and 35°.

6. A luminaire as claimed in claim 5, wherein the first fraction and the second fraction have an intensity ratio in the range of 1:10 to 1:3.

7. A luminaire as claimed in claim 1, wherein the diffusely reflective part comprises a first, a second and a third portion, the second portion being positioned between the first portion and the third portion and being tangentially connected to the first and the third portion, the first portion being concavely curved and comprising the second edge of the diffuesly reflective part which is tangential to the first extremity of the specularly reflective part.

8. A luminaire according to claim 7, wherein, viewed in a cross-section perpendicular to plane P and through both the first and the second end of the shielding means, the second portion has a straight shape.

9. A luminaire as claimed in claim 1, wherein the luminaire has a maximum height of between 1/4 and 1/20 of a minimum width of the light exit window, wherein said height is measured along a perpendicular to the plane P and said width is measured parallel to plane P.

10. A luminaire as claimed in claim 1, wherein the diffusely reflective part has a structured reflective surface.

11. A luminaire as claimed in claim 1, wherein the luminaire further comprises a remote phosphor layer arranged on the diffusely reflective part and/or on the light exit window, the remote phosphor layer comprising a luminescent material for converting at least part of the light emitted by the light source to light of a different color.

12. A luminaire as claimed in claim 1, wherein the luminaire further comprises an array of further light sources arranged on the diffusely reflective part for direct illumination of the light exit window, a color of the light emitted by the light source being different from a color of the light emitted by the array of further light sources.

13. A luminaire for indirect illumination, the luminaire comprising:

shielding means extending in a plane P and adapted to shield contacting means for holding a light source from being directly viewed by an observer through a light exit window, the shielding means having a first end opposite a second end, the first end bordering a concavely shaped reflective screen and the second end bordering the light exit window, the reflective screen being arranged opposite the light exit window and comprising a specularly reflective part and a diffusely reflective part, a first edge of the diffusely reflective part bordering the light exit window and a second edge bordering a first extremity of the specularly reflective part, a second extremity of the specularly reflective part of the reflective screen bordering the shielding means, said contact means being positioned between the shielding means and the specularly reflective part of the reflective screen, wherein, viewed in a cross-section perpendicular to plane P and through both the first and the second end of the shielding means, the tangent to the first extremity of the specularly reflective part encloses an angle α' of more than 25° with the plane P, wherein, viewed in a cross-section perpendicular to plane P and through both the first and the second end of the shielding means, the tangent to the second extremity of the specularly reflective part encloses an angle α of more than 90° with the plane P.

14. A luminaire for indirect illumination, the luminaire comprising:

shielding means extending in a plane P and adapted to shield contacting means for holding a light source from being directly viewed by an observer through a light exit window, the shielding means having a first end opposite a second end, the first end bordering a concavely shaped reflective screen and the second end bordering the light exit window, the reflective screen being arranged opposite the light exit window and comprising a specularly reflective part and a diffusely reflective part, a first edge of the diffusely reflective part bordering the light exit window and a second edge bordering a first extremity of the specularly reflective part, a second extremity of the specularly reflective part of the reflective screen bordering the shielding means, said contact means being positioned between the shielding means and the specularly reflective part of the reflective screen, wherein, viewed in a cross-section perpendicular to plane P and through both the first and the second end of the shielding means, the tangent to the first extremity of the specularly reflective part encloses an angle α' of more than 25° with the plane P, wherein the luminaire further comprises a remote phosphor layer arranged on the diffusely reflective part and/or on the light exit window, the remote phosphor layer comprising a luminescent material for converting at least part of the light emitted by the light source to light of a different color.

* * * * *